US005406992A

United States Patent [19]

Miramon

[11] Patent Number: 5,406,992

[45] Date of Patent: Apr. 18, 1995

[54] SELF CONTAINED EVACUATION LID

[75] Inventor: Eric J. Miramon, Morro Bay, Calif.

[73] Assignee: Jeff Stuebing, Paso Robles, Calif.

[21] Appl. No.: 49,005

[22] Filed: Apr. 19, 1993

[51] Int. Cl.[6] ..... B65D 51/24

[52] U.S. Cl. ..... 141/65; 141/64; 215/228; 53/88; 220/204; 417/545

[58] Field of Search ..... 141/65, 63, 64, 66, 141/69; 215/228, 260, 309, 312; 53/88; 220/204, 203, 206, 303; 417/545, 234, 554

[56] References Cited

U.S. PATENT DOCUMENTS

| | | | |
|---|---|---|---|
| 2,890,810 | 6/1959 | Rohling . | |
| 3,452,510 | 7/1969 | Fry | 53/88 |
| 3,672,114 | 6/1972 | Sacks | 53/88 |
| 4,016,999 | 4/1977 | Denzer | 220/231 |
| 4,033,091 | 7/1977 | Saponara | 53/88 |
| 4,118,152 | 10/1978 | Bron | 417/545 X |
| 4,249,583 | 2/1981 | Lundbladh | 141/65 |
| 4,278,114 | 7/1981 | Ruberg | 141/65 |
| 4,372,096 | 2/1983 | Baum | 53/88 |
| 4,640,426 | 2/1987 | Wasley | 215/228 |
| 4,763,803 | 8/1988 | Schneider | 215/260 |
| 4,768,665 | 9/1988 | Ballas | 215/228 |
| 4,823,968 | 4/1989 | Handzlik | 215/228 |
| 4,824,340 | 4/1989 | Bruggeman et al. | 417/234 X |
| 4,909,014 | 3/1990 | Kobayashi | 53/86 |
| 4,981,233 | 1/1991 | Scheurer | 215/228 X |
| 5,207,339 | 5/1993 | Shyu | 215/228 |

*Primary Examiner*—Ernest G. Cusick

[57] ABSTRACT

Self contained evacuation lid adapted for containers allowing the contents of the container (30) to be stored under a reduced pressure atmosphere after the container (30) has been opened. The evacuation lid forms a closure over the container (30) which incorporates a bellows pump (12) for removing air from container (30). The evacuation lid also includes a air intake valve (14) for venting the container (30) to facilitate the removal of the lid.

18 Claims, 8 Drawing Sheets

SELF CONTAINED EVACUATION LID

BACKGROUND OF THE INVENTION

1. Field of the Invention

This invention relates to the sealing and resealing of any storage container lid purchased by a consumer. It is important to note that the evacuation lid is easily used by consumers who are elderly or physically disabled.

2. Description of the Prior Art

Grocery stores and super markets commonly supply consumers with perishable foods. Many of these foods such as condiments and sauces are stored in containers with screw on/screw off lids. It is well known that it can be difficult for people to seal and reseal screw lids, especially people who are physically disabled, elderly or anyone suffering from corpol tunnel syndrome or arthritis.

It is also well known that perishable foods stored in a reduced pressure atmosphere stays fresher longer and can be stored for a longer period of time.

Inventors have created several types of lids to improve on the simplicity and convenience of sealing and resealing containers under a negative pressure. However, none of the prior art we searched related to the use of their product by people who are physically disabled.

Although the prior art appears to be of good construction and design it is difficult to use by people who have a physical disability. Expensive to produce and package. Has achieved no commercial value that we know of. The previous art has no safe guards to prevent liquids from being sucked up into the evacuation device and are not easily cleaned.

SUMMARY OF THE INVENTION

Accordingly, several objects and advantages of the present invention are:

(a) to provide a self contained evacuation lid which can be easily adapted to a container, making sealing and resealing a painless and simple procedure for people who are physically disabled;

(b) to provide a self contained evacuation lid that makes carrying the container easier for people who are physically disabled;

(c) to provide specially designed teeth grip, I.D. marks and rocking lid to make the product available for use by people who are physically disabled.

(d) to provide an interchangeable seal which makes product usable on a wider range of jar sizes;

(e) to provide a self contained evacuation lid that is inexpensive to manufacture, making it possible to produce, package and sell on a large scale;

(f) to provide a self contained evacuation lid that is marketable to both the general public and people who are physically disabled;

(g) to provide a self contained evacuation lid that can be made in part from recycled plastics;

(h) to provide a rocking motion lid allowing for maximum evacuation of container;

(i) to provide a self contained evacuation lid that can be easily cleaned; and (j) to provide a complete line of self contained evacuation lids and containers.

Other inventors have provided numerous variations of vacuum sealing lids and devices. Although these variations appear to be functional in operation and adequate in design they are difficult to use by people who have a physical disability. Asymmetrical in shape, making production and packaging difficult and expensive. In addition the majority of prior art does not allow for maximum air evacuation of a container.

Self contained evacuation lid can be used to help many of the 42 million Americans with a physical disability. As well as people living in convalescent homes, rehabilitation centers and hospitals around the world.

Other uses for the evacuation lid are on thermoses, coolers, meat trays and crispers in refrigerators and for home canning.

Although the descriptions above contain many specifications these should not be construed as limiting the scope of the invention but as merely providing illustrations of some of the presently preferred embodiments of this invention. For example, the lid can have other shapes such as square, rectangular or triangle.

Thus the scope of the invention should be determined by the appended claims and their legal equivalents, rather than by the examples given.

Further objects and advantages of our invention will become apparent from a consideration of drawings and ensuing description.

DESCRIPTION OF THE PREFERRED EMBODIMENTS

Figure 1:
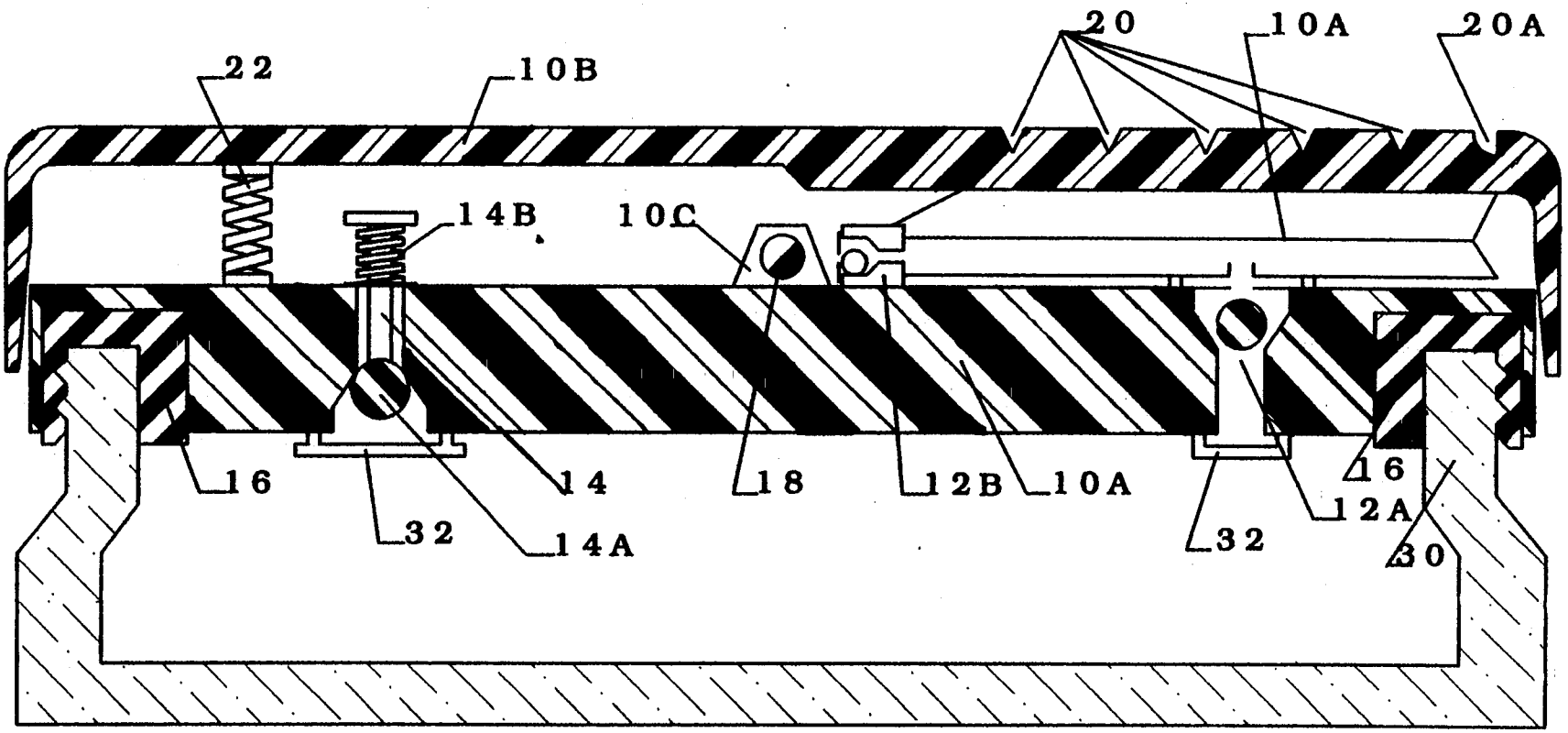
FIG. 1 is across section of a self contained evacuation lid incorporating the construction and concepts of the invention.

Referring to FIG. 1, the container 30 in this particular example is cylindrical and formed of glass, but the invention is adaptable to containers having other shapes and sizes and formed of other materials. Containers need not have any specialized characteristics to be compatible with the evacuation lid. The invention may be used with existing containers found in households, restaurants and stores.

Components of the system consist of a sealplate 10A machine grooved on the bottom 10D for a preformed interchangeable seal 16 made of a resilient material molded around the top edge of container 30 and sealplate also seal plate 10A. Sealplate 10A will be made of a rigid plastic, preferably recycled. There will be mounting flanges 10C protruding above the top of sealplate 10A. Sealplate 10A is connected to top enclosure 10B with preformed pivot pins 18. Pivot pins 18 allow top enclosure 10B to rock in upward and downward strokes. The upward and downward strokes allow top enclosure 10B to pump bellows 12. Bellows 12 will be injection molded with a durable, resilient plastic, preferably recycled. Bellows 12 houses a suction port 12A and an exhaust port 12B. Both suction port 12A and exhaust port 12B are preformed and hermetically sealed within the bellows 12. For illustration only, we show, as in FIG. 4, the use of a stemmed spherical ball valve 14A with a rod and biased to a closed position by spring 14B for both of these devices, but other types of valves may be used. With a downward stroke of the top enclosure, air is evacuated from the container. Repeating this downward stroke creates a vacuum seal between the container and the sealplate.

Figure 5:
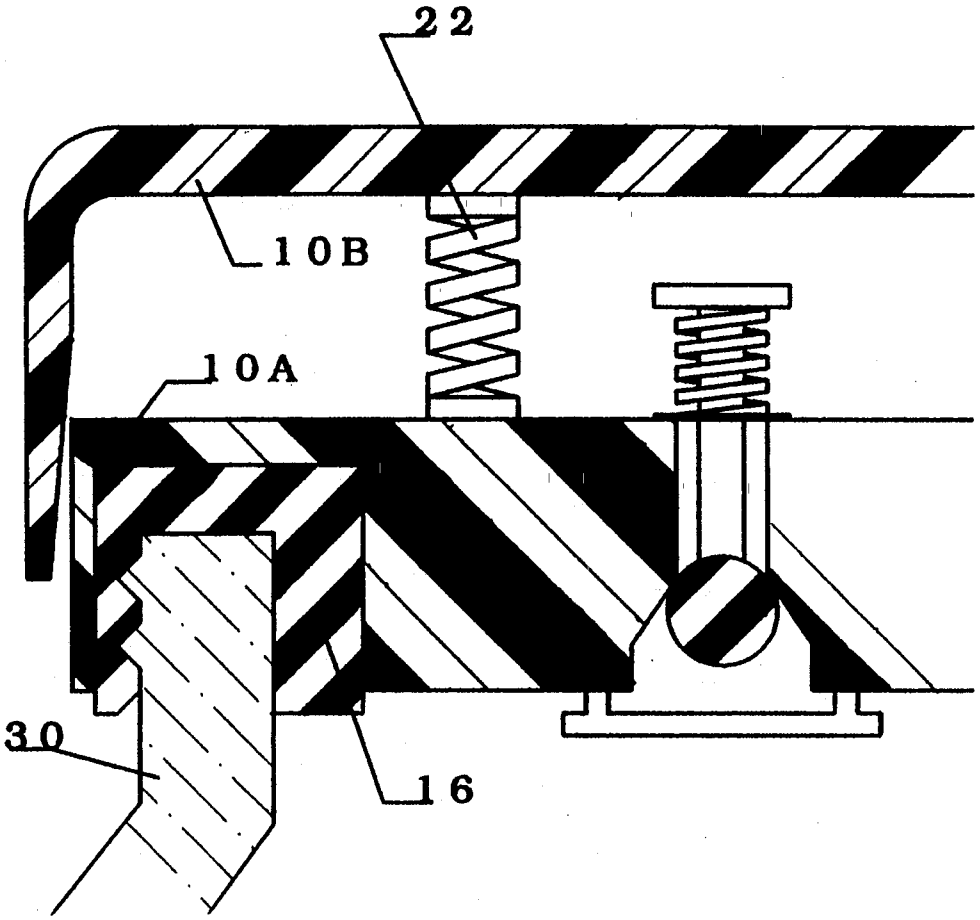
FIG. 5 is a cross section showing dual purpose coil spring 22 in conjunction with top enclosure 10B and seal plate 10A.
Figure 6:
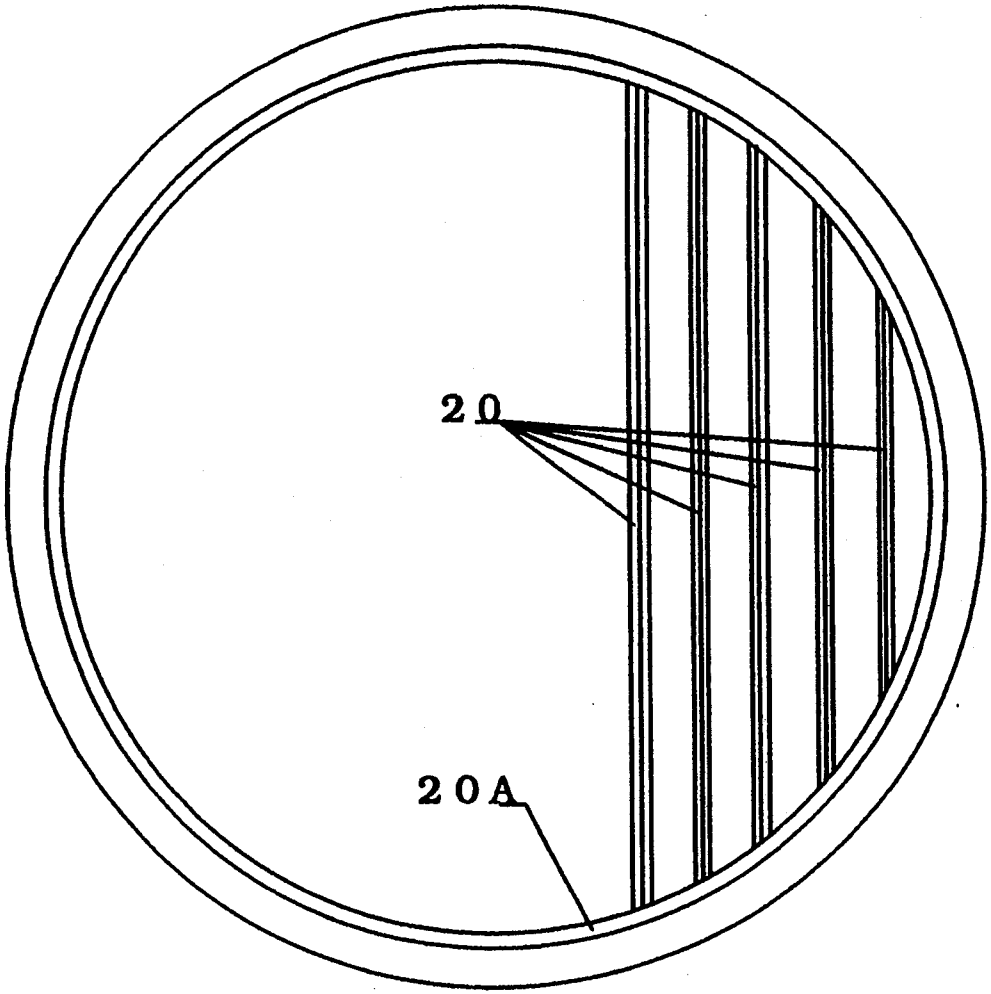
FIG. 6 is a top view of invention in FIG. 1.

Referring to FIG. 5, the coil spring 22 has two functions. The first is to aid in the upward strokes for maximum evacuation of the container. The second is to act as a stabilizer for stacking containers.

Figure 4:
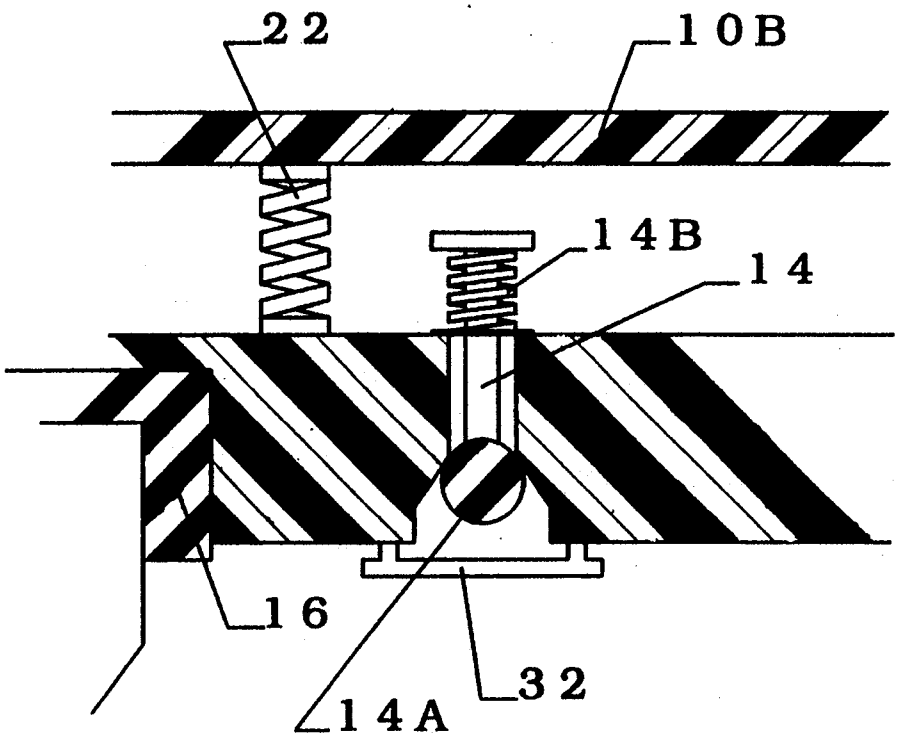
FIG. 4 is a cross section showing intake valve 14 as one method of air intake.

FIG. 4 refers to air intake valve 14. A full stroke on the release side of top enclosure 10B allows the air intake valve 14 to be opened and air to flow into the container to remove the lid. A food barrier 32 is disposed on the underside of the valve 14. Grip teeth 20A permit a user to pivot enclosure 10B about the pivot pins 18, thus allowing valve 14 to open and air to flow into the container.

Figure 2:
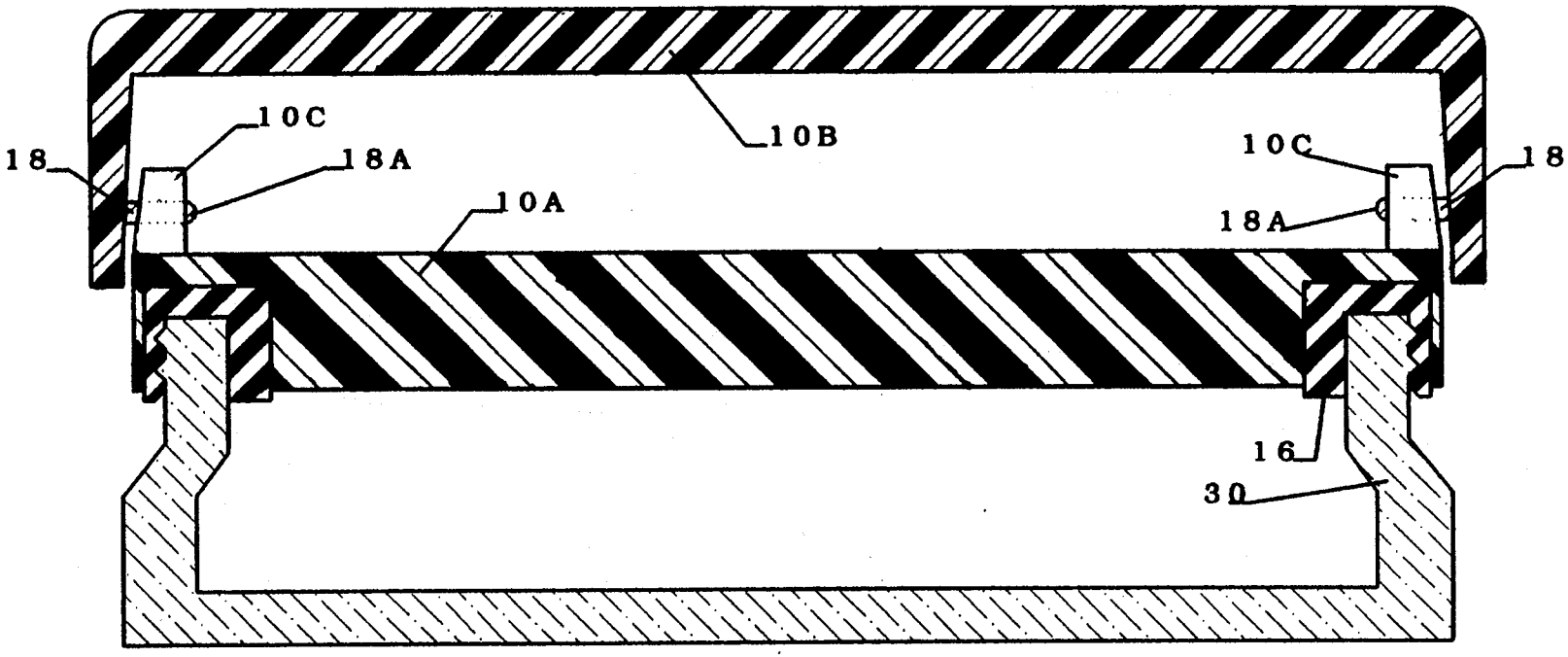
FIG. 2 is a cross section showing pivot pins 18 of top enclosure 10B in connection with the seal plate 10A.
Figure 3:
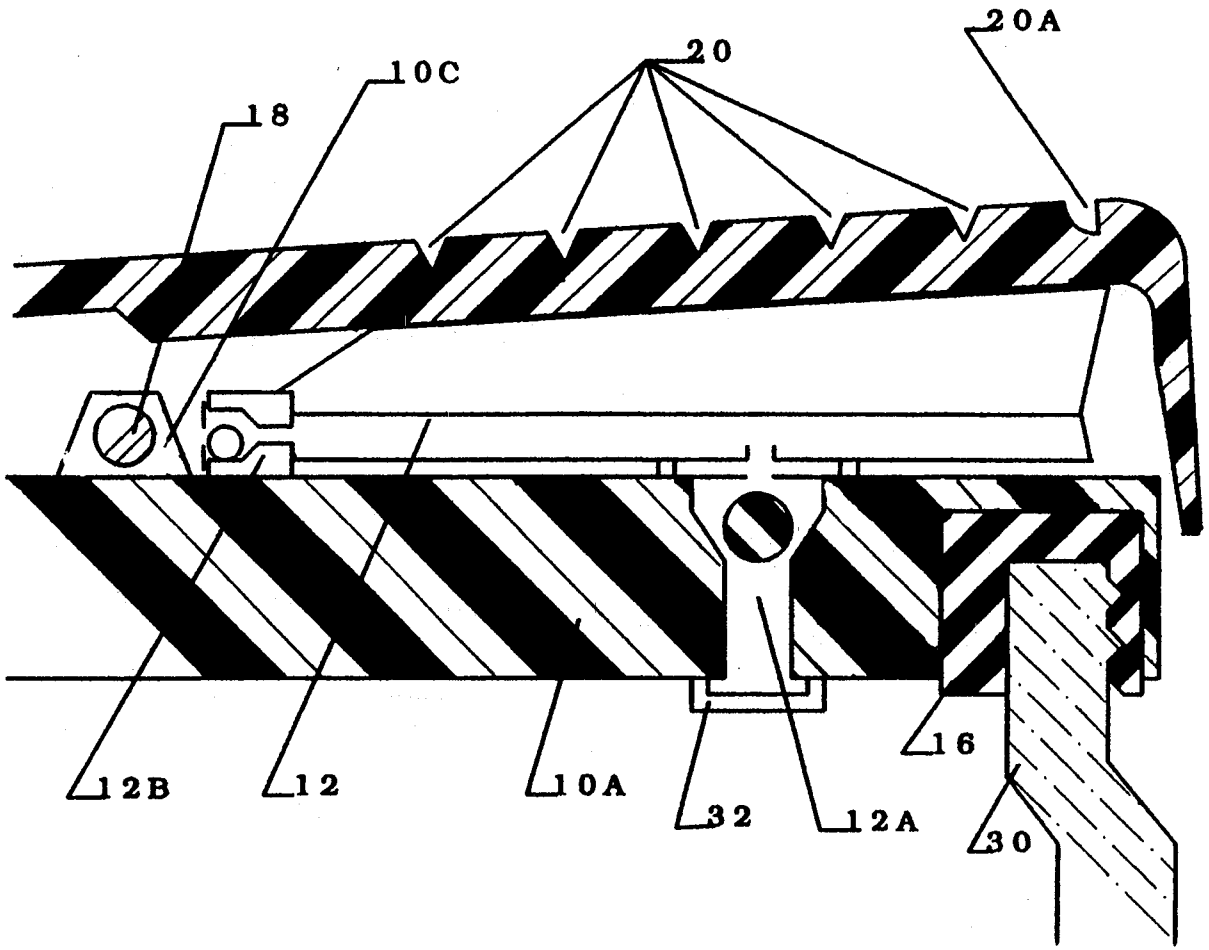
FIG. 3 is a partial cross section showing bellows pump 12 in the upward stroke.

FIG. 2 is a typical embodiment of the invention, showing a cross section of top enclosure 10B and pivot pins 18 with enlarged ball head 18A. Pivot pins 18 also act as a connection between top enclosure 10B and sealplate 10A. They allow for the rocking motion of top enclosure 10B, making it possible to pump bellows 12.

Figure 7:
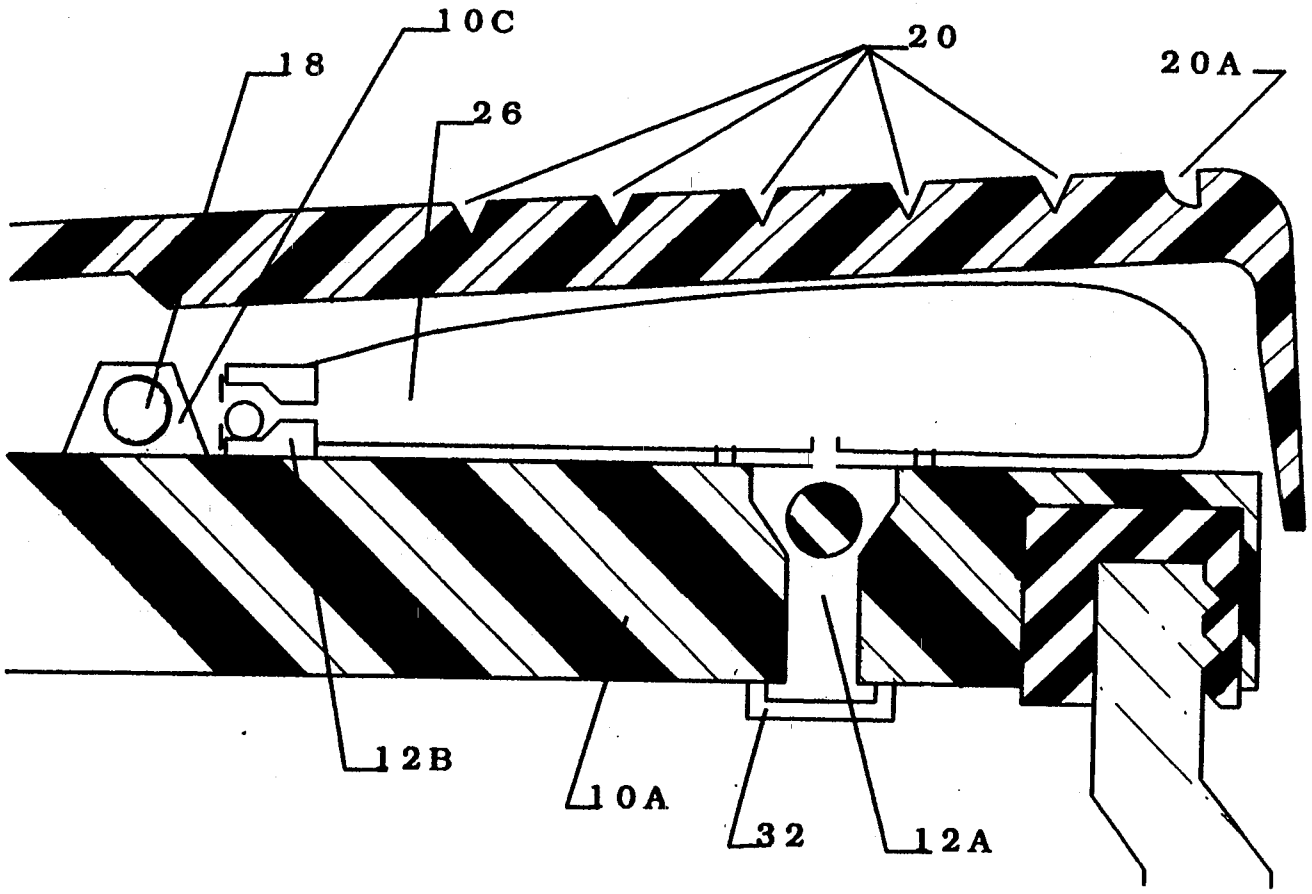
FIG. 7 is a partial view of FIG. 1 using a bladder 26 as an evacuation device.

FIG. 7 shows another modified embodiment of this invention with a bladder 26 as the air evacuation device. To facilitate the evacuation process, bladder 26 can be made from a flexible rubber or plastic material. Bladder 26 is located between top enclosure 10B and sealplate 10A and is hermetically sealed with the inside of the container through suction port check valve 12A.

Figure 8:
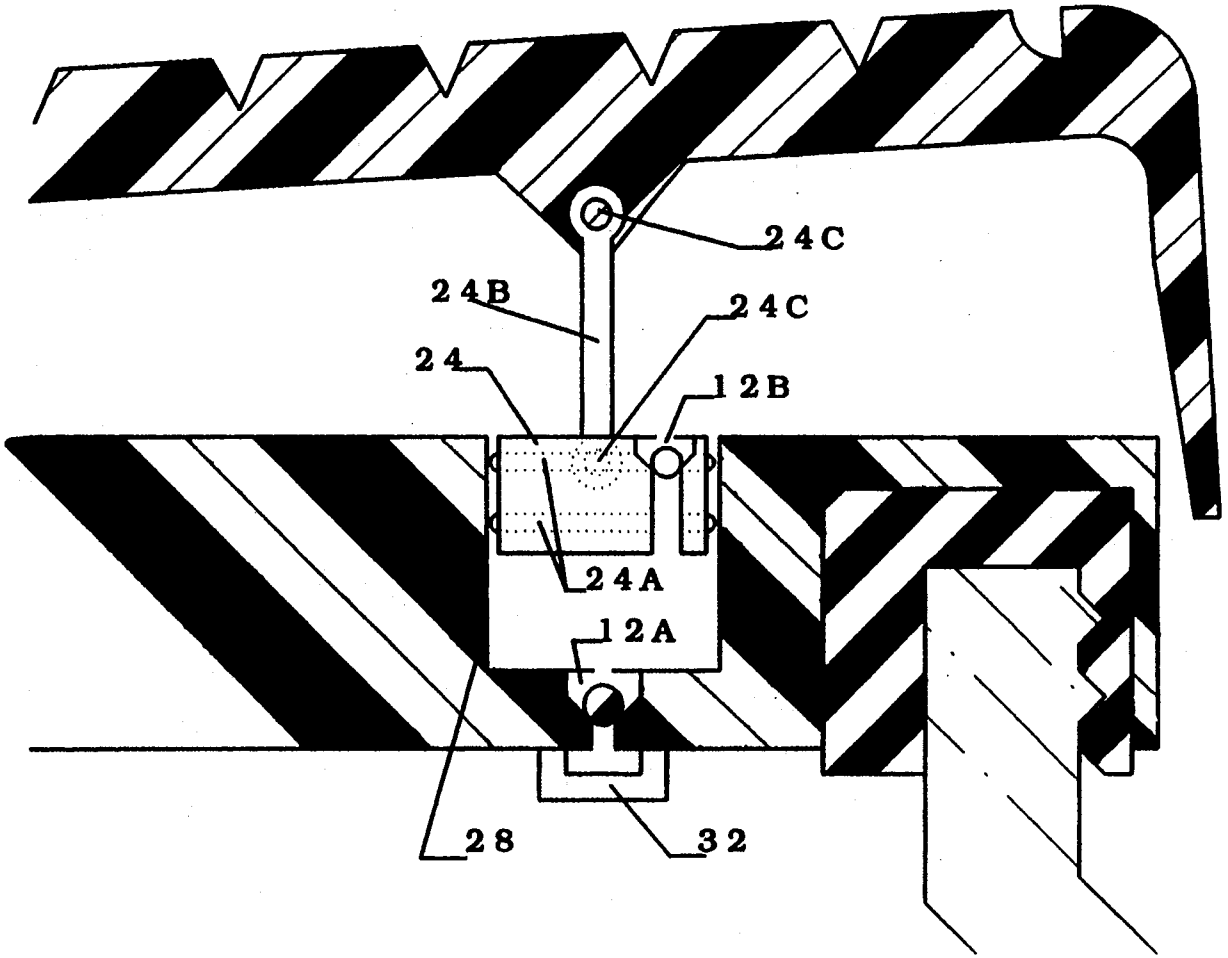
FIG. 8 is a partial view of FIG. 1 using a piston 24 as an evacuation device.

FIG. 8 shows a third modified embodiment of the invention with a piston 24 as the evacuation device. Piston rod 24B is located between top enclosure 10B and sealplate 10A. Sealplate 10A has piston chamber 28A with a suction port check valve 12A to remove air from the container when top enclosure 10B activates piston 24 in the upward stroke. Piston 24 has an exhaust port check valve bored through it to facilitate the removal of air from piston chamber 28A on the down stroke of top enclosure 10B. Piston rod 24B is attached to top enclosure 10B and to piston 24 with piston rod pins 24C. Piston 24 is hermetically sealed within cylinder walls 28 with resilient rubber or plastic 0-rings 24A. 0-rings 24A fit around piston 24 in a grooved slot to prevent 0-rings from shifting out of place.

Reference Numerals in Drawings

10A Sealing Plate
10B Top Enclosure
10C Mounting Flange
10D Machined Groove for Seal
12 Bellows Pump
12A Suction Port
12B Exhaust Port
14 Air Intake Valve
14A Spherical Ball Valve
14B Compression Spring
14C Intake Port
16 Seal
18 Pivot Pin
18A Enlarged Ball Head
20 I.D. Marks for Pump Side
20A Teeth Grip
22 Coil Spring
24 Piston
24A Sealing Ring
24B Piston Rod
24C Piston Rod Pins
26 Bladder
28 Cylinder Wall
28A Piston Chamber
30 Container
32 Food Barrier

I claim:

1. A closure and evacuation assembly for a container, the container having an open top; the assembly comprising, a seal plate having two faces, the seal plate having on one face a seal cooperating with the open top of the container to provide an sealing relation between the container and the plate;

the other face of the plate having mounting flanges;

a top enclosure mounted to the other face of the plate, said top enclosure having two enclosure faces, one of the enclosure faces having pivot pins cooperating with the mounting flanges of the plate to permit pivoting of the enclosure on the plate, the other face of the enclosure defining an evacuation section and a release section;

a bellows mounted on the other face of the plate proximate the evacuation section of the enclosure, mounted between the plate and the enclosure whereby a space is provided between the plate, enclosure and bellows, said space being opposite the bellows;

the plate having two through passages from said face to said other face, each passage provided with a one way check valve, one of the passages having a first check valve in cooperation with the bellows permitting air flow from the container to the bellows when the plate is in cooperation with the container;

the other passage in the plate having the other check valve cooperating with the space to permit air flow into the container when the plate is in cooperation with the container;

the bellows further containing a bellows check valve permitting air flow out of the bellows;

whereby upon connection of the plate onto a container so that the seal defines said sealing relation, a downward pressure on the evacuation section of the enclosure proximate the bellows compresses the bellows and initially permits air in the bellows to exit the bellows through the bellows check valve, and release of the pressure then permits expansion of the bellows and thus withdrawal of air from the container through the first check valve into the bellows as the bellows expands.

2. The closure and evacuation assembly for a container as in claim 1, the other check valve includes an actuation rod and a valve portion connected to the rod cooperating with a seat defined in the passage, where depression of the enclosure at the release section permits the one face of the enclosure to contact the actuation rod of the other check valve and open the other check valve to permit air flow into the container.

3. The closure and evacuation assembly for a container as in claim 2, wherein the valve portion is a ball valve.

4. The closure and evacuation assembly for a container as in claim 1, further including a spring between said enclosure and said plate to bias said enclosure upwardly from said plate.

5. The closure and evacuation assembly for a container as in claim 1, further including a groove in said one face of said seal plate receiving said seal.

6. The closure and evacuation assembly for a container as in claim 1, wherein the evacuation section of the enclosure includes identification marks in the form of grooves.

7. The closure and evacuation assembly for a container as in claim 1, wherein the pivot and mounting flanges are located at the periphery of the seal plate and the enclosure.

8. The closure and evacuation assembly for a container as in claim 1, wherein the bladder is constructed from a rubber material.

9. The closure and evacuation assembly for a container as in claim 1, wherein the bladder is accordion-shaped.

10. The closure and evacuation assembly for a container as in claim 2, wherein the a teeth grip is located at the periphery of the enclosure to facilitate the opening of the other valve.

11. A closure and evacuation assembly for a container, the container having an open top; the assembly comprising, a seal plate having two faces, the seal plate having on one face a seal cooperating with the open top of the container to provide an sealing relation between the container and the plate;

the other face of the plate having mounting flanges;

a top enclosure mounted to the other face of the plate, said top enclosure having two enclosure faces, one of the enclosure faces having pivot pins cooperating with the mounting flanges of the plate to permit pivoting of the enclosure on the plate, the other face of the enclosure defining an evacuation section and a release section;

a piston cylinder located in the plate and a piston rod sealingly and reciprocatingly mounted in the cylinder and pivotally connected to the other face of the enclosure proximate the evacuation section of the enclosure;

the plate having a through passage from said face to said cylinder, said through passage provided with a one way check valve, permitting air flow from the container to the piston cylinder when the plate is in cooperation with the container;

a piston passage in the piston with a piston check valve located in the piston passage permitting air flow out of the cylinder when the cylinder is moved to reduce the volume of the cylinder;

a further passage in the plate having the other check valve cooperating with the space to permit air flow into the container when the plate is in cooperation with the container;

whereby upon connection of the plate onto a container so that the seal defines said sealing relation, a downward pressure on the evacuation section of the enclosure proximate the piston compresses the moves the piston into the piston cylinder to reduce the volume of the cylinder and initially permits air in the cylinder to exit the cylinder through the piston check valve, and release of the pressure then permits the piston to move and increase the volume of the cylinder and thus withdrawal of air from the container through the one way check valve into cylinder.

12. The closure and evacuation assembly for a container as in claim 11, the further check valve includes an actuation rod and a valve portion connected to the rod cooperating with a seat defined in the passage, where depression of the enclosure at the release section permits the one face of the enclosure to contact the actuation rod of the other check valve and open the further check valve to permit air flow into the container.

13. The closure and evacuation assembly for a container as in claim 11, wherein the valve portion is a ball valve.

14. The closure and evacuation assembly for a container as in claim 11, further including a spring between said enclosure and said plate to bias said enclosure upwardly from said plate.

15. The closure and evacuation assembly for a container as in claim 11, further including a groove in said one face of said seal plate receiving said seal.

16. The closure and evacuation assembly for a container as in claim 11, wherein the evacuation section of the enclosure includes identification marks in the form of grooves.

17. The closure and evacuation assembly for a container as in claim 11, wherein the pivot and mounting flanges are located at the periphery of the seal plate and the enclosure.

18. The closure and evacuation assembly for a container as in claim 12, wherein the a teeth grip is located at the periphery of the enclosure to facilitate the opening of the other valve.

* * * * *